United States Patent [19]

Fujita

[11] Patent Number: 4,729,720

[45] Date of Patent: Mar. 8, 1988

[54] APPARATUS FOR CONTINUOUSLY GENERATING HYDRAULIC PRESSURE

[75] Inventor: Hiromu Fujita, Kyoto, Japan

[73] Assignee: Osaka Taiyu Co., Ltd., Osaka, Japan

[21] Appl. No.: 889,597

[22] Filed: Jul. 25, 1986

Related U.S. Application Data

[63] Continuation of Ser. No. 642,218, Aug. 20, 1984, abandoned.

[30] Foreign Application Priority Data

Aug. 19, 1983 [JP] Japan ..... 58-151881

[51] Int. Cl.[4] ..... F04B 1/00; F04B 27/00

[52] U.S. Cl. ..... 417/271; 417/343; 417/347

[58] Field of Search ..... 417/343, 345, 347, 271; 91/481, 352, 318

[56] References Cited

U.S. PATENT DOCUMENTS

| | | | |
|---|---|---|---|
| 2,435,611 | 2/1948 | Sejarto | 91/180 X |
| 3,295,451 | 1/1967 | Smith | 417/342 |
| 4,153,376 | 5/1979 | Neier | 91/180 X |
| 4,385,869 | 5/1983 | Omata | 417/271 |
| 4,541,779 | 9/1985 | Birdwell | 417/342 |

FOREIGN PATENT DOCUMENTS

| | | | |
|---|---|---|---|
| 1599411 | 9/1981 | United Kingdom | 417/347 |

*Primary Examiner*—Carlton R. Croyle
*Assistant Examiner*—Donald E. Stout
*Attorney, Agent, or Firm*—Armstrong, Nikaido, Marmelstein & Kubovcik

[57] ABSTRACT

An apparatus for generating high hydraulic pressure with reduced pulsations, comprising a valve case attached to a motor main body and having a plurality of pneumatic cylinder units arranged therearound, a rotary valve rotatably fitted in the valve case, links each having one end pivoted to the piston of each pneumatic cylinder unit and the other end connected to an eccentric shaft portion provided on a crank shaft or the rotary valve, and hydraulic bases connected directly to the pneumatic cylinder units individually, the hydraulic pressure fluid being caused to flow-out from the hydraulic bases in succession by the rotation of the rotary valve, in such a manner that when the outflow of the fluid from one of the hydraulic bases is about to cease, the fluid starts to flow out from another hydraulic base, and when the flows of hydraulic fluid from the two hydraulic bases combine, the pulsation of the flow from one base is offset by that of the other single flow, making it possible for the hydraulic fluid to uniformly flow out without pulsation.

2 Claims, 9 Drawing Figures

APPARATUS FOR CONTINUOUSLY GENERATING HYDRAULIC PRESSURE

This application is a continuation of application Ser. No. 642,218 filed Aug. 20, 1984 now abandoned.

TECHNICAL FIELD

The present invention relates to an apparatus for continuously generating hydraulic pressures. More particularly the invention relates to a hydraulic pump for generating a high hydraulic pressure with reduced pulsations to drive hydraulic devices smoothly.

BACKGROUND OF THE INVENTION

Because of the characteristics of hydraulic pressure generating systems, the pressure of hydraulic fluid for driving hydraulic devices involves pulsations, which therefore entail the problem of failing to assure smooth operation of the hydraulic device.

For example, when hydraulic pressure is produced by a cylinder apparatus, a high hydraulic pressure is generated in the oil feed process in which the plunger advances in the hydraulic chamber to force out the hydraulic fluid, whereas the generation of hydraulic pressure ceases in the suction process in which the plunger starts to retract from the end of its forward stroke to draw in the fluid from an oil supply source. thus resulting in a pulsation.

The pulsations of hydraulic pressure can be eliminated by the use of an accumulator for temporarily storing the pressure delivered from the hydraulic pressure generating apparatus, but this entails the drawback that the apparatus becomes expensive and large-sized.

At pharmaceutical plants and factories handling flammable liquids, there is a special need for hydraulic pressure generating apparatus which use no electric motor because electric motors are likely to cause ignition. To meet this need, the present inventor has already proposed an apparatus wherein a hydraulic cylinder unit is connected directly to a pneumatic cylinder unit, and a plunger projecting from the piston of the pneumatic cylinder unit is slidably intimately fitted in the hydraulic chamber of the hydraulic cylinder unit so that the piston, when reciprocated, drives the plunger to generate hydraulic pressure (Published Unexamined Japanese Patent Application SHO No. 53-43210).

The apparatus includes two pistons which are made slightly different in the timing of reciprocation and of the resulting generation of hydraulic pressure to produce a combined hydraulic pressure with reduced pulsations. Although thus excellent, the apparatus still permits slight pulsations to remain in the hydraulic pressure.

SUMMARY OF THE INVENTION

An object of the present invention is to provide an apparatus having pneumatic cylinder units driven by pneumatic pressure for continuously producing hydraulic pressure which is almost free of pulsations.

The apparatus of the present invention is characterized in that it comprises:

a valve case 6 attached to a motor main body 1 and having a plurality of pneumatic cylinder units 2 arranged therearound, the valve case having air channels 37 communicating with the cylinder individually and opened along a circumference, a rotary valve 7 rotatably fitted in the valve case 6 and having in its interior an air supply chamber 71 communicating with a compressed air source and an air discharge chamber 72 positioned symmetrically with the air supply chamber 71 and communicating with the atomosphere, links 24 each having one end pivoted to the piston 21 of each pneumatic cylinder unit 2 and the other end connected to an eccentric shaft portion 54 provided on a crank shaft 5 or the rotary valve 7, and hydraulic bases 3 connected directly to the pneumatic cylinder units 2 individually and each provided with a hydraulic chamber 31 having slidably intimately fitted therein a plunger 23 projecting from the piston 21 of the corresponding pneumatic cylinder unit, the hydraulic base 3 having an inflow valve 35 communicating with the hydraulic chamber 31 and permitting flow of hydraulic fluid from an oil supply source into the hydraulic chamber 31 and an outflow valve 36 communicating with the hydraulic chamber 31 and permitting flow of the hydraulic fluid from the hydraulic chamber 31 to an oil outlet.

According to the invention, when compressed air is fed to the cylinder of one of the pneumatic cylinder units, the piston is moved, permitting the hydraulic fluid to flow from the oil supply source into the hydraulic chamber of the corresponding hyraulic base and causing the link pivoted to the piston to push the eccentric shaft portion of the crank shaft, which in turn pushes the piston of another pneumatic cylinder unit which is positioned symmetrically with the above unit for the discharge of air and generation of hydraulic pressure.

At the same time, the rotary valve is rotatingly displaced by the rotation of the crank shaft to change the pneumatic cylinder unit in suction process for another and continuously rotate the crank shaft, changing the pneumatic cylinder unit which generates hydraulic pressure. Thus, a plurality of hyraulic cylinder units cause the hydraulic fluid of high pressure to flow out from the oil outlet to be connected to a hydraulic device.

The pressure variation of the hydraulic fluid flowing out from one hydraulic cylinder unit is offset and made uniform by the pressure variation of the hydraulic fluid from another hydraulic cylinder unit, making it possible to supply to the oil outlet hydraulic fluid of high pressure with reduced pulsation.

DETAILED DESCRIPTION OF THE INVENTION

Figure 1:
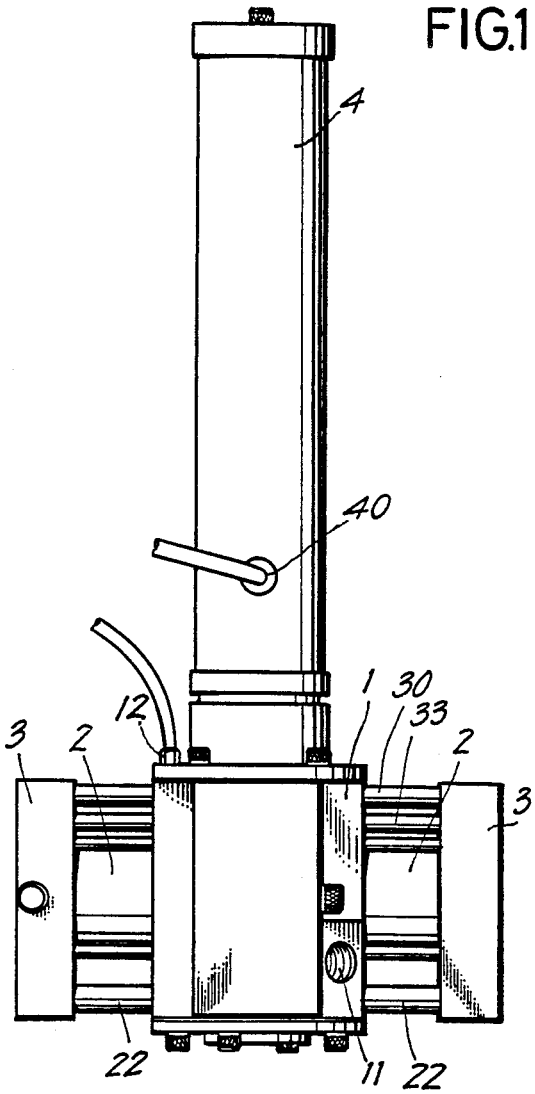
FIG. 1 is a front view of an apparatus of the present invention.
Figure 2:
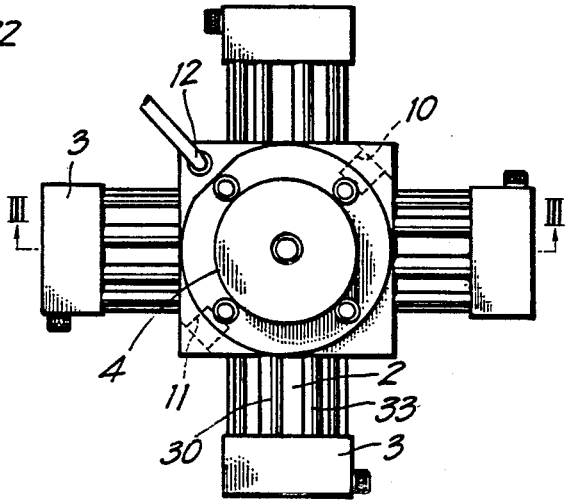
FIG. 2 is a plan view of the apparatus of the present invention.

As shown in FIG. 1 and FIG. 2, the hydraulic pressure generating apparatus of the invention comprises four pneumatic cylinder units 2 arranged around a motor main body 1 and each provided with a hydraulic base 3.

However, pneumatic cylinder units having numbers larger or smaller than four may be used.

The motor main body 1 is formed with an air inlet 10 connected to a pressurized air source (not shown) and an air outlet 11 communicating with the atmosphere to drive the pneumatic cylinder units 2 and the hydraulic bases 3 in succession.

The motor main body 1 has an oil outlet 12 for suppying a hydraulic fluid to an hydraulic device (not shown). The returning hydraulic fluid from the hydraulic device is led into a return inlet 40 of an oil tank 4 attached to the motor main body.

The motor main body 1 is provided at its top side with a housing 13, which rotatably supports a crank shaft 5 with a ball bearing 50 and a needle bearing 51.

The housing 13 is formed in its inner surface with a circumferential oil supply groove 14 which is always filled with the hydraulic fluid through a plurality of holes 53 formed in the peripheral wall of an upper cylindrical portion 52 of the crank shaft 5.

The hydraulic base 3 has an oil supply channel 32, which is in communication with the oil supply groove 14 through an oil supply pipe 30 and through oil supply bores 15, 16 extending through the motor main body 1 and the peripheral wall of the housing 13, respectively, whereby the channel is supplied with the hydraulic fluid.

Figure 6:
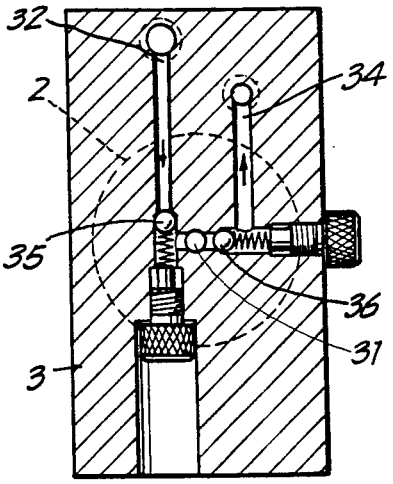
FIG. 6 is a view in section taken along the line VI—VI in FIG. 3.
Figure 5:
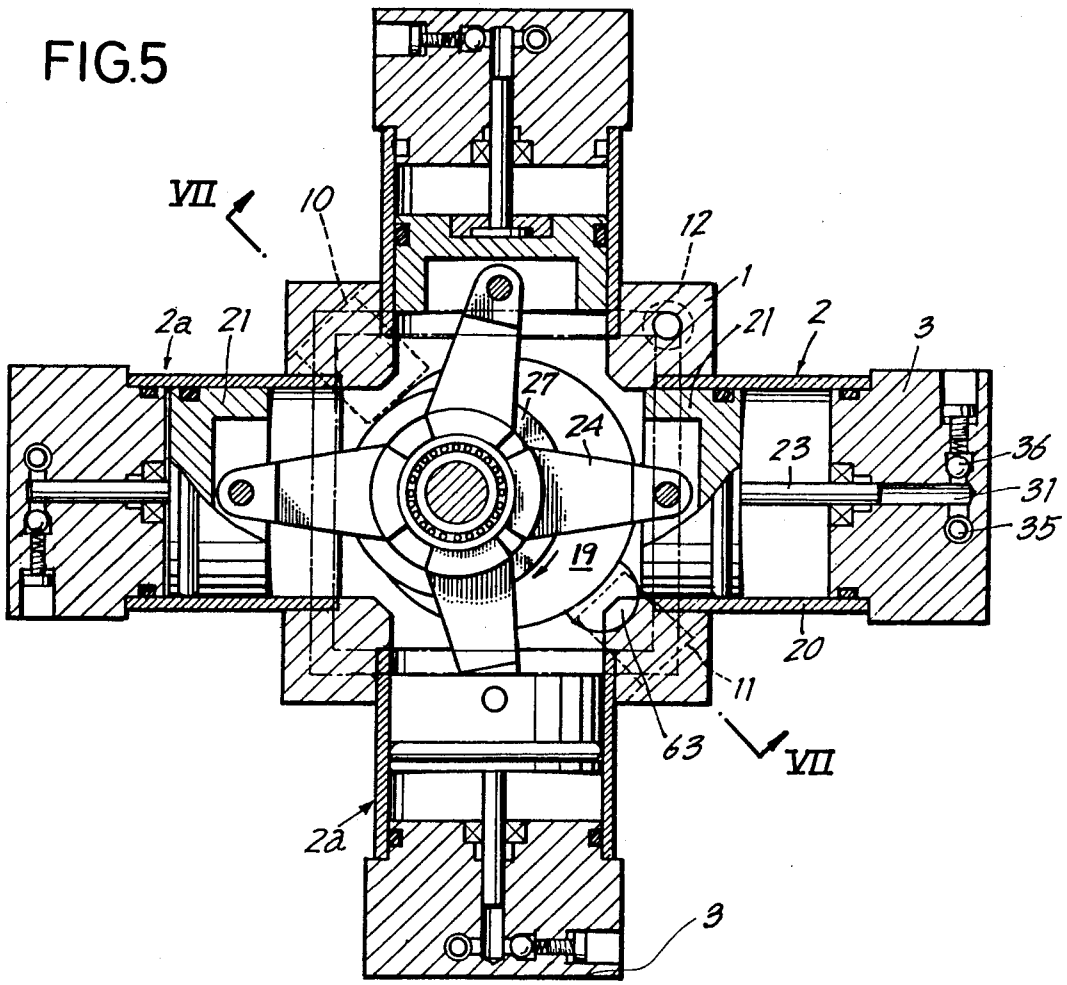
FIG. 5 is a view in section taken along the line V—V in FIG. 3.
Figure 7:
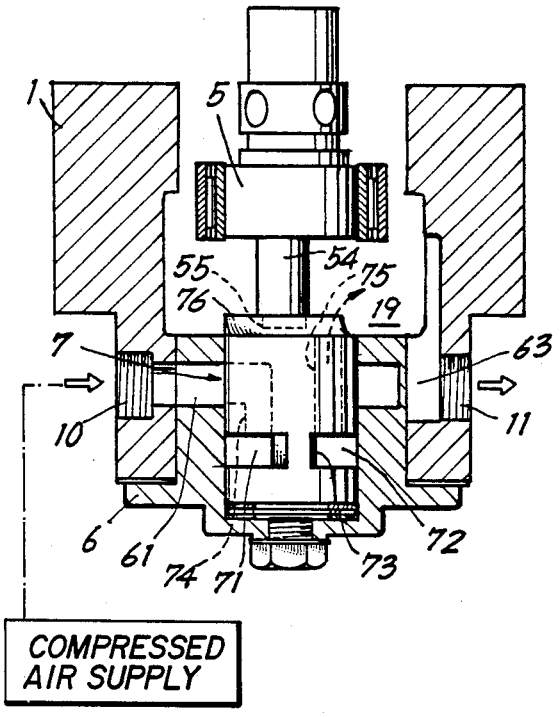
FIG. 7 is a view in section taken along the line VII—VII in FIG. 5.

The hydraulic base 3 has a hydraulic chamber 31 in alignment with the center line of the corresponding pneumatic cylinder unit 2. As shown in FIG. 6, one end of the hydraulic chamber 31 is in communication with the oil supply channel 32 communicating with the oil supply pipe 30 and an oil feed channel 34 which communicates with an oil feed pipe 33 connected between the motor main body 1 and the hydraulic base 3.

The oil supply channel 32 has an inflow valve 35 comprising a ball pressed against a valve seat by a spring for permitting only inflow of the hydraulic fluid into the hydraulic chamber 31 and preventing reverse flow of the fluid, while the oil feed channel 34 has an outflow valve 36 for permitting only outflow of the fluid from the chamber 31.

The motor main body 1 has a channel 17 extending in its interior in a round and communicating with the oil feed pipes 33. The channel 17 communicates with the oil outlet 12 via a bore. The high-pressure hydraulic fluid from the oil feed pipes 33 is collected in the channel 17 and supplied to the external hydraulic device through the oil outlet 12.

Each pneumatic cylinder unit 2 comprises a cylinder 20 having opposite open ends and connected between and hermetically fitted in the motor main body 1 and the corresponding hydraulic base 3 in alignment with the center line of the hydraulic chamber 31, and a piston 21 slidably provided in the cylinder. The hydraulic base 3 internally has an air channel 37 having an open end at one end of the cylinder 20 and the other end communicating with an air pipe 22 connected between the motor main body 1 and the hydraulic base 3.

A plunger 23 extends from the center of the piston 21 toward the hydraulic base 3. The forward end of the plunger 23 is liquid-tightly and slidably fitted in the hydraulic chamber 31 which is open at the end face of the hydraulic base 3.

A link 24 oriented toward the motor main body 1 is slidably pivoted at its base end to each piston 21 by a pin 25. The link 24 extends toward an eccentric shaft portion 54 of the crank shaft 5. The forward end of the link 24 has a boss 26 which is formed with a circular arc end face in conformity with the outer periphery of the outer ring of a needle bearing 51 which is fitted around the eccentric shaft portion 54.

The circular arc end faces of the links 24 extending from the pneumatic cylinder units are positioned around the eccentric shaft portion 54 to surround the shaft portion 54. The outer periphery of the bosses 26 are cylindrical.

Figure 3:
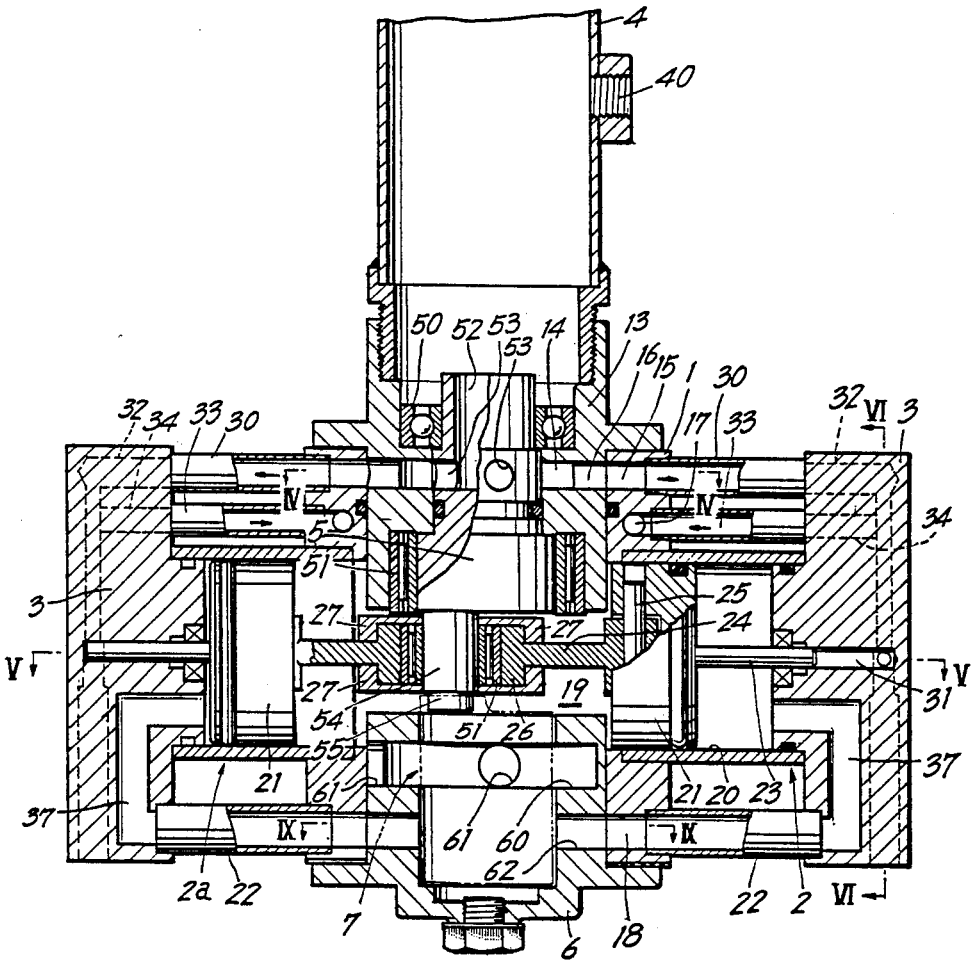
FIG. 3 is a view in section taken along the line III—III in FIG. 2.
Figure 4:
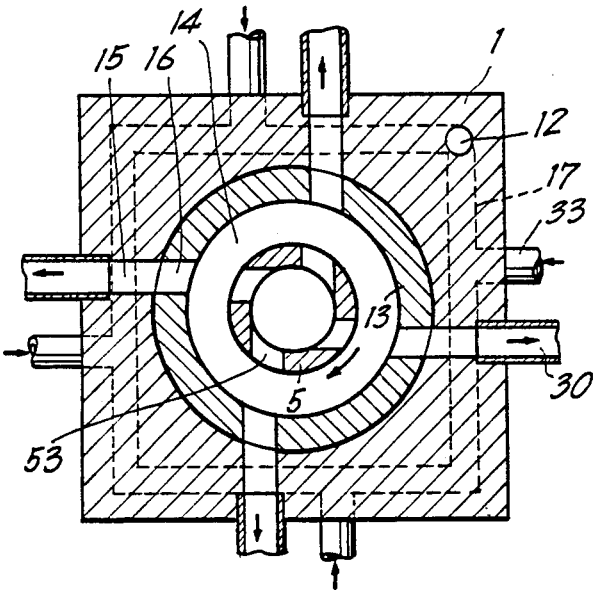
FIG. 4 is a view in section taken along the line IV—IV in FIG. 3.

Holding rings 27, 27 are fitted around the bosses 26 of the links 24 from above and below to restrain the bosses and hold the circular arc end faces of the links 24 always in contact with the eccentric shaft portion 54, rendering the links 24 reciprocatingly movable at the same time with the movement of the eccentric shaft portion 54 (FIG. 3 and FIG. 4).

A valve case 6 which is open at its upper side is fitted in the lower portion of the motor main body 1. A rotary valve 7 is rotatably supported by and disposed in the valve case 6.

The valve case 6 is formed in an upper portion of its inner surface with an air supply groove 60 at the same level as the air inlet 10 formed in the peripheral wall of the motor main body 1. A bore 61 extends through the bottom of the air supply groove 60 toward the air inlet 10, whereby the groove 60 of the valve case 6 is always filled with the compressed air supplied from the air inlet 10.

Figure 9:
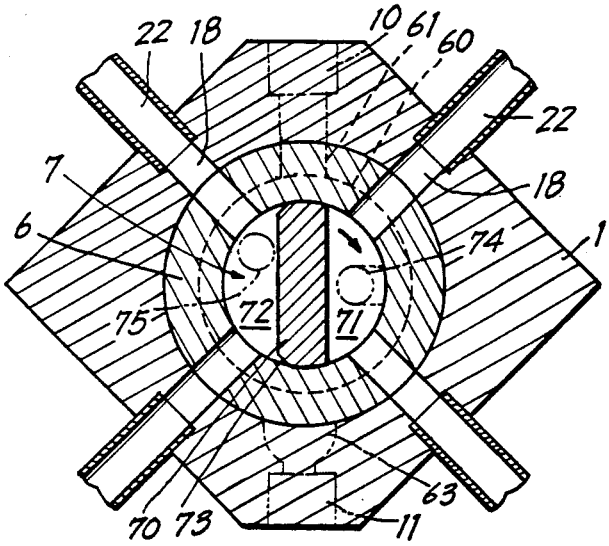
FIG. 9 is a view in section taken along the line IX—IX in FIG. 3.

The air pipes 22 communicating with the pneumatic cylinder units 2 are fitted, each at one end, in air bores 18 extending through the four sides of the motor main body 1 as seen in FIG. 9. Holes 62 in register with the air bores 18 of the motor main body 1 are formed in the peripheral wall of the valve case 6 at a lower position than the air supply groove 60.

Figure 8:
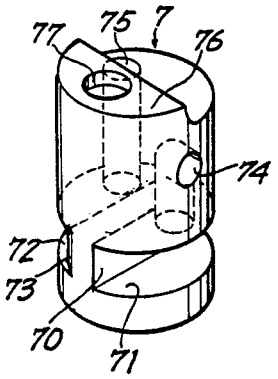
FIG. 8 is a perspective view of a rotary valve.

At the same level as the holes 62 in the valve case 6, the rotary valve 7 has approximately semicircular cutouts at opposite sides of central partition 70 to form an air supply chamber 71 and an air discharge chamber 72 as seen in FIG. 8. The air discharge chamber 72 has a small (about 1 mm) slanting guide face 73 at each end of its opening to make the opening length of the air discharge chamber 72 slightly larger than that of the air supply chamber 71.

The rotary valve 7 has an air supply channel 74 haivng one end open to the air supply chamber 71 and the other end open at its peripheral surface at the level of the air supply groove 60 of the valve case 6, and an air discharge channel 75 having one end open to the air discharge chamber 72, extending upward and having the other end open at the upper surface of the valve 7.

Formed between the inner surface of the motor main body 1 and the valve case 6 is a release channel 63 communicating at its one end with the air outlet 11 and extending upward to the other end where it is open to a crank room 19. The air discharged from the rotary valve 7 is released to the atmosphere from the air outlet 11 via the crank room 19 and the release channel 63.

An engaging cavity 77 is formed in an engaging portion 76 projecting from the upper surface of the rotary valve 7 to a level higher than the opening of the air discharge channel 63. An engaging shaft portion 55 projecting from the forward end of the eccentric shaft portion 54 of the crank shaft 5 is engaged in the cavity 77 of the rotary valve 7 to make the rotary valve 7 rotatable with the crank shaft 5.

In practicing the present invention, an engaging shaft portion may be formed on the engaging portion 76 of the rotary valve 7, with an engaging cavity formed in the end face of the eccentric shaft portion 54 of the crank shaft 5 to engage the two members.

Further alternatively, it is possible to remove the eccentric shaft portion 54 from the crank shaft 5 and form an eccentric shaft portion on the engaging portion 76 of the rotary valve 7 to engage the shaft portion with the links 24 of the pneumatic cylinder units 2, with the crank shaft 5 made integral with the housing 13 without the eccentric shaft portion 54.

With the apparatus of the present invention, the air supply chamber 71 and the air discharge chamber 72 of the rotary valve 7 are each in communication with the opening of at least one of the holes 62 of the valve case 6 at all times to whatever position the rotary valve 7 may be rotated, so that the compressed air supplied from the air inlet 10 of the motor main body 1 flows through the air supply groove 60 of the valve case 6, the air supply channel 74 of the rotary valve 7 and the air supply chamber 71 thereof into the corresponding air pipe 22 to retract the piston 21 in the cylinder 20.

Accordingly, the link 24 pivoted to that link 21 rotates the crank shaft 5 and the rotary valve 7 by pushing the eccentric shaft portion 54 of the crank shaft 5 and, at the same time, pushes the link 24 of another pneumatic cylinder unit 2*a* positioned symmetrically with the above unit to advance its piston 21 for the discharge of air.

The air discharge chamber 72 of the rotary valve 7 is adapted to communicate with the pneumatic cylinder unit 2*a* at the air discharge side via the bore 18, hole 62, air pipe 22 and air channel 37, so that the moment the air discharge chamber 72 of the rotary valve 7 comes into communication with the air pipe 22, the air in the cylinder is discharged from the air outlet 10 by way of the rotary valve 7 and the release channel 63.

Further by the advance of the piston 21, the air in the cylinder 20 is forced out with the rotation of the rotary valve 7 and the crank shaft 5, and the air discharge process is completed when the eccentric shaft portion 54 is positioned toward the pneumatic cylinder unit 2 at the air discharge side.

Because the air discharge chamber 72 has the guide face 73 at each end and is slightly longer than the air supply chamber 71 in the length of its opening, the rotation of the rotary valve 7 starts to discharge air from the pneumatic cylinder unit 2*a* first and then starts to supply air to the other pneumatic cylinder unit 2 positioned symmetrically therewith, hence a smooth operation. Through continued rotation of the rotary valve 7, air can be supplied to and discharged from the pneumatic cylinder units 2 repeatedly.

When the pneumatic cylinder unit 2 (the cylinder at right in FIG. 3) is in the suction process, the plunger 23 is in the most retracted position in the corresponding hydraulic base 3, filling the hydraulic fluid into its hydraulic chamber 31 via the oil supply pipe 30, oil supply channel 32 and inflow valve 35.

At the same time, with the pneumatic cylinder unit 2*a* (at left in FIG. 3), the plunger 23 advances with the piston 21 into the hydraulic chamber 31, so that the compressed hydraulic fluid passes through the outflow valve 36, oil feed channel 34 and oil feed pipe 33, flows into the channel 17 in the motor main body 1 and flows out from the oil outlet 12 together with the hydraulic pressure fluid from another hydraulic base.

According to the present invention, the hydraulic pressure fluid is caused to flow out from the hydraulic bases in succession by the rotation of the rotary valve 7, such that when the ouflow of the fluid from one of the hydraulic bases is about to cease, the fluid starts to flow out from another hydraulic base. When the flows of hydraulic fluid from the two hydaulic bases combine, the pulsation of the flow from one base is offset by that of the other single flow. This makes it possible for the hydraulic fluid to flow out from the oil outlet 12 uniformly free of pulsation.

When the apparatus was initiated into operation by supplying compressed air of 4 to 5 atm. to the motor main body, the rotary valve rotated at 700 to 1000 r.p.m., generating a high hydraulic pressure of 300 atm. without pulsation.

The present invention is not limited to the foregoing structures but can of course be modified variously within the technical scope as set forth in the accompanying claims.

What is claimed is:

1. An apparatus for generating continuous pulsating free hydraulic pressure comprising a motor having a main body, said main body having a plurality of pneumatic cylinder units mounted circumferentially around the axis of said body and connected to a crankshaft, each of said cylinder units having a cylinder, hydraulic base connected directly to said cylinder and piston in said cylinder connected to said crankshaft, a plunger projecting from said piston and slidably intimately fitted in a hydraulic chamber in said hydraulic base, the pistons in said cylinder units being reciprocatingly movable, one after the other, by pneumatic pressure to drive the plungers, rotate said crankshaft and generate continuous hydraulic pressure as said pistons are reciprocated and said plungers advance inwardly into said hydraulic chambers in said bases, each of said cylinder units having a hydraulic fluid outflow line for receiving hydraulic fluid under pressure from each said cylinder unit, an air valve case mounted on said motor main body, said air valve case having air channels communicating individually with said cylinders and opening circumferentially around said air valve case, a rotary air valve rotatably fitted in said air valve case and having in its interior an air supply chamber with a compressed air source and an air discharge chamber positioned symmetrically with said air supply chamber and communicating with the atmosphere, each of said pistons having link means connected at one end of said piston and at its opposite end to said crankshaft, said cranshaft having an eccentric portion for rotating said rotary air valve in said air valve case and for connecting said air channels, one after the other, with said individual cylinders, said air discharge chamber in said rotary air valve being open at the surface of said rotary air valve over a length longer than the opening length of said air supply chamber, a hydraulic fluid inflow line interconnecting said hydraulic chamber with a hydraulic oil supply, each of said hydraulic bases at said hydraulic chambers having an inflow valve in said inflow line for permitting fluid flow from said inflow line into said hydraulic chamber and for preventing flow of fluid under pressure from each hydraulic chamber into said inflow line and an outflow valve in said outflow line for permitting flow of fluid under pressure from said hydraulic chamber into said outflow line and for preventing flow of fluid under pressure from said outflow line into said chamber, said opening of said air discharge chamber in said rotary air valve over a length longer than the length of said air supply chamber causing the pressured fluid from a first of said plurality of hydraulic chambers flowing into a first of said plurality of cylinders outflow line and the pressure fluid from a second of said plurality of hydraulic chambers starting to flow into a second of said plurality of cylinders outflow line when the outflow of fluid from the first hydraulic chamber is about to cease, the fluid from the first and the second hydraulic chambers being thus combined to provide pressured fluid free of pulsation.

2. The apparatus as defined in claim 1 wherein said air discharge chamber has a small slanting guide face at each end of its opening.

* * * * *